US011718379B2

(12) United States Patent
Mongiardino

(10) Patent No.: US 11,718,379 B2
(45) Date of Patent: Aug. 8, 2023

(54) EQUIPMENT FOR THE REVERSIBLE CONVERSION OF A SAILBOAT HULL INTO A ROWING BOAT

(71) Applicant: Bartolomeo Mongiardino, Las Palmas de Gran Canaria (ES)

(72) Inventor: Bartolomeo Mongiardino, Las Palmas de Gran Canaria (ES)

( * ) Notice: Subject to any disclaimer, the term of this patent is extended or adjusted under 35 U.S.C. 154(b) by 112 days.

(21) Appl. No.: 17/430,700

(22) PCT Filed: Feb. 26, 2020

(86) PCT No.: PCT/IB2020/051633
§ 371 (c)(1),
(2) Date: Aug. 12, 2021

(87) PCT Pub. No.: WO2020/174415
PCT Pub. Date: Sep. 3, 2020

(65) Prior Publication Data

US 2022/0153397 A1 May 19, 2022

(30) Foreign Application Priority Data

Feb. 27, 2019 (IT) ..... 102019000002817

(51) Int. Cl.
*B63H 16/067* (2006.01)
*B63H 16/06* (2006.01)

(52) U.S. Cl.
CPC ..... *B63H 16/067* (2013.01); *B63H 2016/063* (2013.01)

(58) Field of Classification Search
CPC ..... B63H 16/067; B63H 2016/063; B63H 16/06; B63B 34/30; B63B 7/085
See application file for complete search history.

(56) References Cited

U.S. PATENT DOCUMENTS 4,068,611 A * 1/1978 Leather ..... B63H 16/06 114/39.21
5,975,004 A * 11/1999 Nesseth ..... B63H 16/105 440/102
2005/0009421 A1 1/2005 Muser
2008/0302293 A1 12/2008 Nesseth

FOREIGN PATENT DOCUMENTS

FR 2301436 9/1976

* cited by examiner

*Primary Examiner* — Andrew Polay
(74) *Attorney, Agent, or Firm* — Themis Law

(57) ABSTRACT

Equipment for the conversion of a sailboat hull, having a substantially rectangular cockpit, into a rowing boat includes a frame that is substantially rectangular. Such frame is shaped to be arranged with the two major sides at the two major sides of the cockpit and is provided with a removable locking system of the frame to the hull of the boat. Two cantilever members jut out beyond the sides of the hull and are connected to the frame at one end and are provided with rowlocks on the other end. A seat is also provided, slidable along at least one couple of guides parallel to the major sides of the frame.

10 Claims, 3 Drawing Sheets

EQUIPMENT FOR THE REVERSIBLE CONVERSION OF A SAILBOAT HULL INTO A ROWING BOAT

The present invention concerns boats, and particularly concerns equipment that allows to reversibly convert a sailboat hull into a rowing boat.

Currently, the boats for practicing rowing are generally made to be used in substantially still waters, and have constructive characteristics which make the cost difficult to access for widespread use. It is still thus difficult to think of practicing rowing with boats of simple structure, although provided with sufficient stability, along the sea coasts, where it is anyhow necessary, also whenever the surface is relatively calm, to have a hull that is able to address the surface currents and which simultaneously allows to row with a gesture that is at least comparable, although preferably similar, to that of Olympic rowing.

The research which led to the development of the present invention started from the consideration that, in the field of rowing, a type of boat with dimensions of standardized characteristics and at low cost that is able to address open waters, so that to favor the growth of the practicing public and, consequently, also that of participants in competitions, is in fact not available. About fifty years ago, this "revolution" was instead achieved in the field of the sailing sport with the creation of boats of a small size and of relatively contained equipment, which are able to be driven by a single person and to be easily transported with a simple trolley or even on the roof of a car. This type of boats has allowed the institutions of the respective sailing classes, the Sunfish and Laser classes, which currently account for an impressive number of competitive practicing athletes, and which in fact contribute to a very wide diffusion of the sailing sport, which was instead only intended for the wealthiest classes for a very long time.

These boats are provided with a hull of little and generally standardized size, between 4 and 5 meters, with a removable mast, and with a cockpit for holding the driver; the hull is provided with a movable centerboard and has good stability.

Object of the present invention is to provide equipment that is able to convert the hull of a sailboat into a boat fit for the practice of rowing, with particular efficacy in coastal rowing, by exploiting the wide diffusion of this type of boats and their objectively low cost.

A further object of the present invention is to provide equipment that allows such conversion in a fully reversible way, by ensuring that the user is in a condition of possessing two tools for the practice of two different sports with absolutely low costs.

Object of the present invention is thus an equipment for the conversion of a sailboat hull provided with a substantially rectangular cockpit, into a rowing boat, said equipment comprising a frame, substantially rectangular, shaped to be arranged with the two major sides at the two major sides of the cockpit, said frame being provided with removable locking means of said frame at the hull of said boat, two cantilever members being provided, jutting out beyond the sides of said hull and connected to said frame at one end and being provided with rowlocks on the other end, and a seat slidable along at least one couple of guides parallel to the major sides of said frame being provided.

In a preferred embodiment, a footrest, suitably oriented and fixed to said frame in an adjustable way, is provided on the side of the same frame facing the stern of said hull.

In an embodiment variant, said cantilever members comprise two suitably oriented arms, each fixed to the junction angle between the side of the frame facing the stern of the hull and the two major sides of the frame.

In a further embodiment variant, each cantilever member comprises a couple of arms fixed at one end to the frame, suitably spaced from each other and coupled with each other at the opposite end, which provides support to the rowlock.

In a further embodiment variant, said cantilever members each comprise an arm jutting out cantileverly from said frame, connected to a further arm at the support of the rowlock, said further arm being coupled to the edge of the respective side of the hull.

In a further embodiment variant, a cavity (pit) is provided inside the cockpit of the hull for housing the movable centerboard, and locking means to lock said frame to said hull can comprise an expansion pivot able to cooperate with the housing cavity of the movable centerboard.

Still according to an embodiment which can be provided in any combination or sub-combination with the characteristics listed above, a helm, comprising a blade swinging around a vertical axis and a bar for driving said blade, is combined with the hull, said bar being combined with control members delimiting the steering angle and/or regulating the rigidity of the helm and which are sent back inside the cockpit in a position accessible by the user.

An embodiment provides two control lines fixed at the end of the bar, which control lines branch off in directions opposite from the end thereof and are sent back, at the respective side of the hull, by return members towards the cockpit, a removable locking member, such as for example a stopper or the like, being provided at each side of the cockpit, preferably of each angle zone, and within which the end length of each line is engaged.

Further advantages and characteristics of the equipment according to the present invention will become clearer in the following description of some embodiments thereof, by way of example and non-limiting, with reference to the accompanying drawings, in which.

Figure 1:
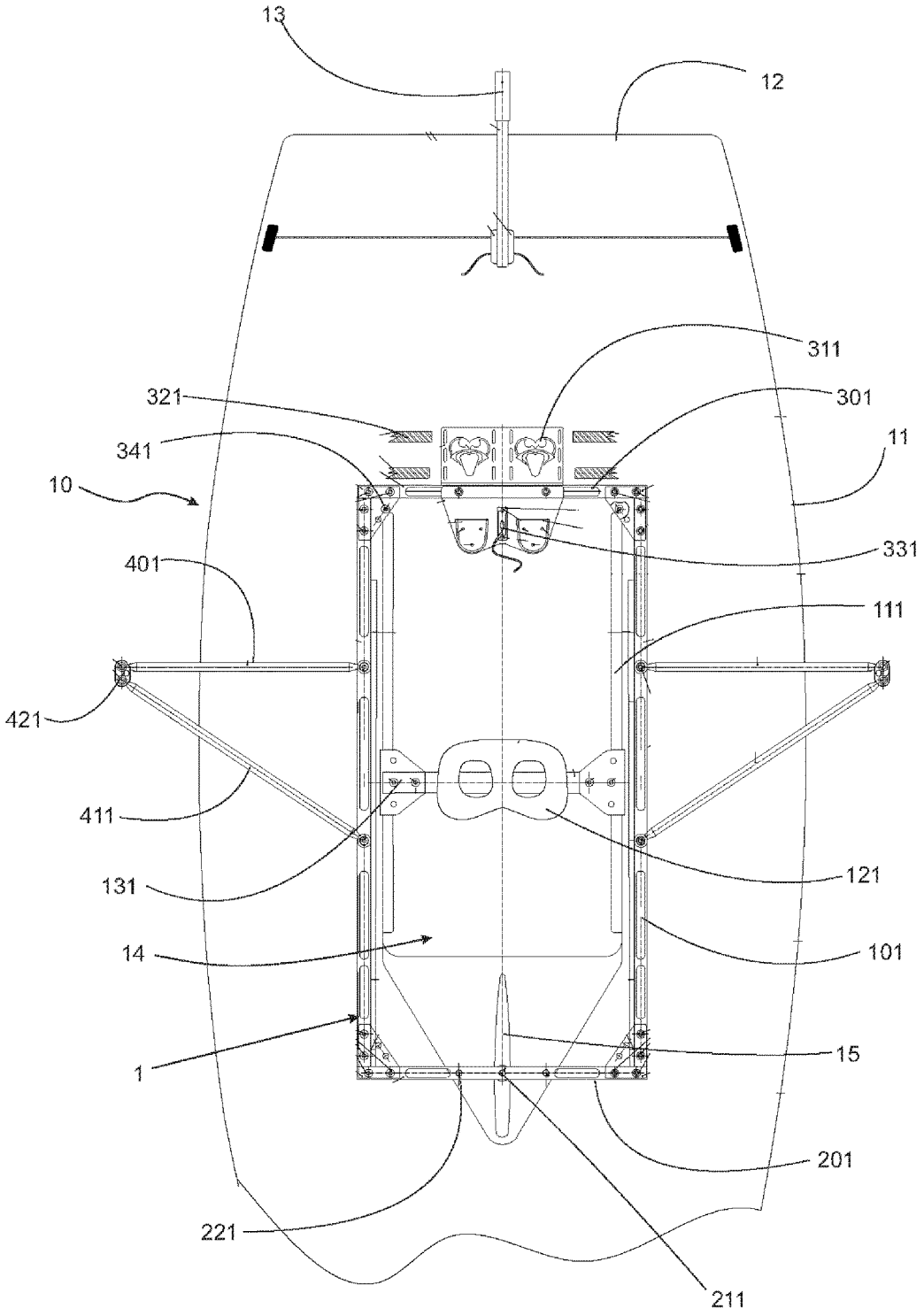
FIG. 1 is a top plan view of a first embodiment of the equipment according to the present invention, mounted on the hull of a Laser class boat.

A top plan view of a first embodiment of the equipment according to the present invention, mounted on the hull of a Laser class boat, is shown in the figure. The hull 10 has the sides 11, the cockpit 14 with the characteristic rectangular shape with the triangular forward extension, the stern 12 with the helm 13, and the pit 15 for housing the movable centerboard. The frame 1 comprises the major sides 101 arranged parallel to the sides 11, the bow side 201 and the stern side 301. The guides 111, on which the trolley 131 bringing the seat 121 slides by means of appropriate means better described below, are positioned along the major sides 101.

The stern side 301 of the frame 1 is provided with a footrest 311 suitably fixed thereto in an adjustable way and provided with strips 321 to secure the feet of the user. The locking means 341 are provided at the two end angles of the frame 1 facing the stern side 301, whereas a stopper 331, arranged in the footrest 311, allows to secure the frame with a line anchored to the hull.

The two arms 401 and 411, arranged spaced at a given distance from each other at an end, are secured on each of the major sides 101 of the frame 1, whereas the opposite end is connected in 421 to provide support for the rowlock, not shown in the figure.

The locking means 211, able to cooperate with the pit 15 for housing the centerboard, and the locking means 221, cooperating with the wall of the triangular extension of the cockpit 14, are provided on the bow side 201 of the frame 1.

Figure 2:
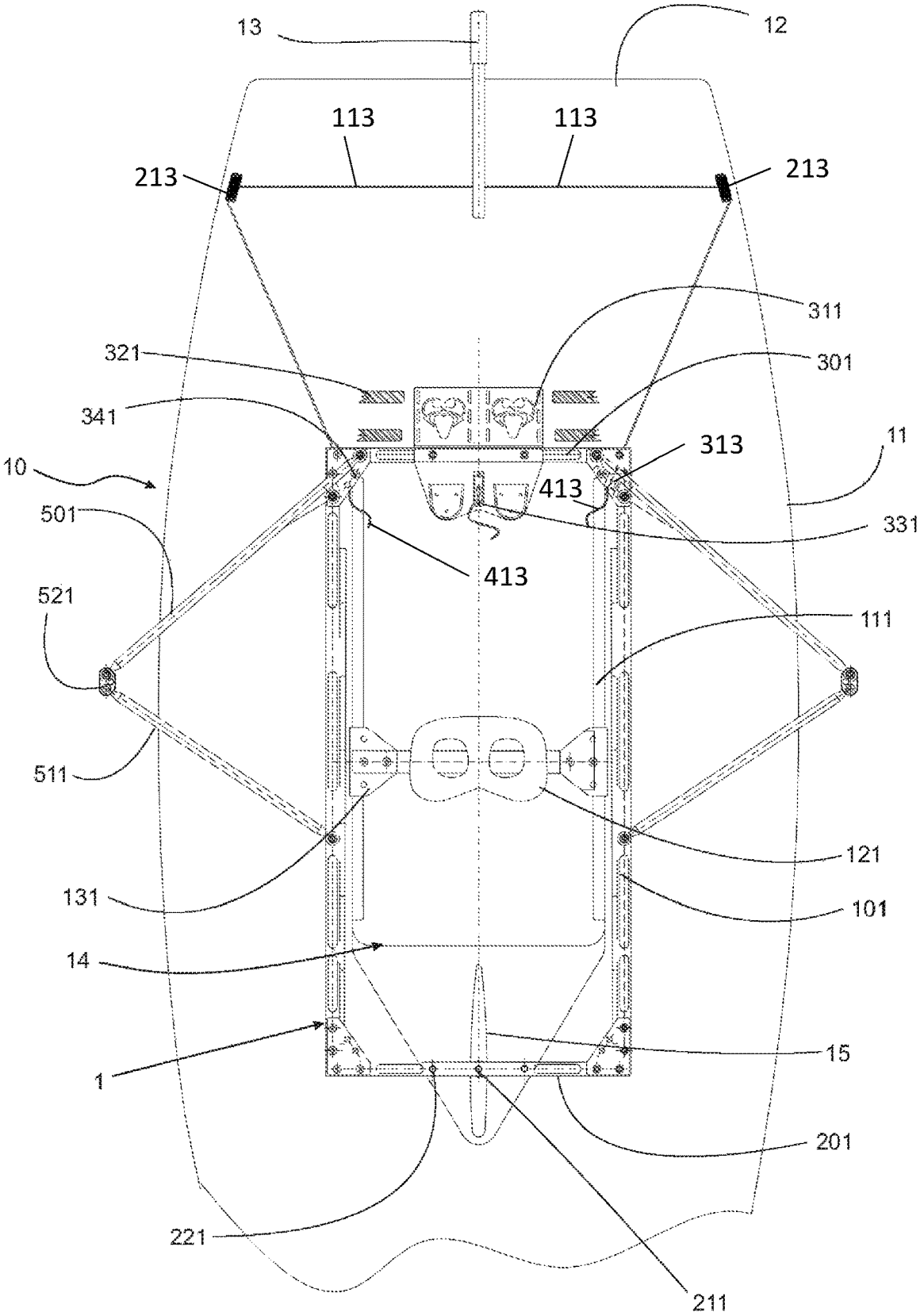
FIG. 2 is a top plan view of a second embodiment of the equipment according to the present invention.

An alternative embodiment of the equipment according to the present invention, also whenever mounted on the hull of a Laser class boat, is shown in FIG. 2. Equal numerals correspond to equal parts; in the figure, it can be noted that two arms 501 are provided jutting out cantileverly from the frame 1, which are positioned at the connecting point between the stern side 301 and the ends of the major sides 101; the rowlocks will be arranged at the ends 521 of the arms 501.

As is clear in FIG. 2, in this variant, each arm 501 consists of two small arms 511 oriented convergent one towards the other in direction of their ends 521, whereas the opposite ends are fixed to the side member of the frame 1 oriented in direction of the longitudinal axis of the hull. Respectively, in forward, towards the bow, and rearward, towards the stern, points of the corresponding small bow and stern arm 511.

Figure 3:
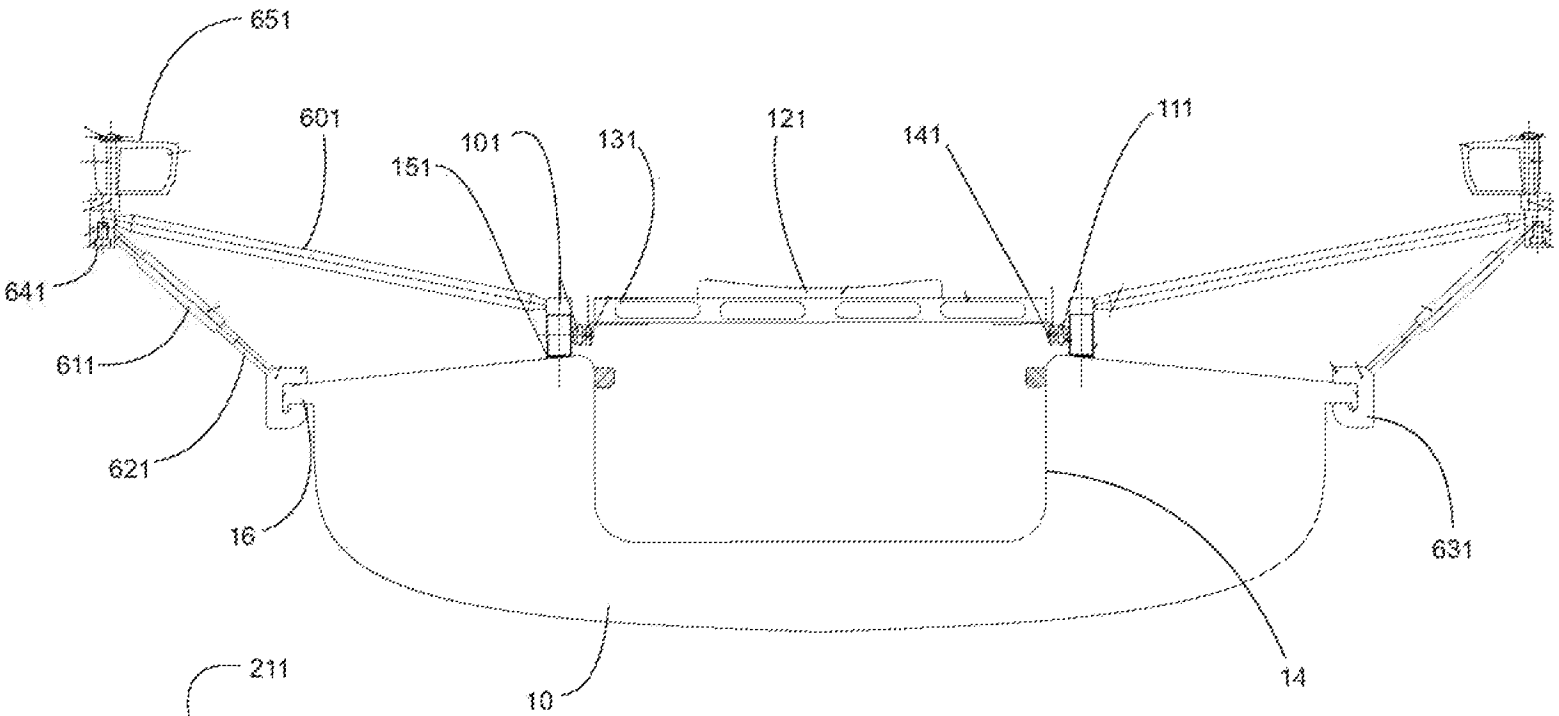
FIG. 3 is a cross-sectional view of a third embodiment of the equipment according to the present invention.

A further embodiment of the equipment according to the present invention, always coupled with the hull of a Laser class boat, is shown in FIG. 3. Also in this case, equal numerals correspond to equal parts; the arms 601 connected cantileverly to the major sides 101 of the frame 1, which join in 641 with the further arms 611 provided with telescopic extension 621, whose free end has a vice 631 which is coupled with the edge 16 of the walls 11 of the hull 10, are shown in the figure. The rowlocks 651 are mounted at the joint 641 between the arms 611 and the arms 601. The position of the rollers 141 of the trolley 131, which cooperate with the guides 111 integral with the major sides 101 of the frame 1, is further shown in the figure. The lower face of the major sides 101 is provided with one layer of elastically yielding material 151 that goes into contact with the surface of the hull around the cockpit 14.

Figure 4:
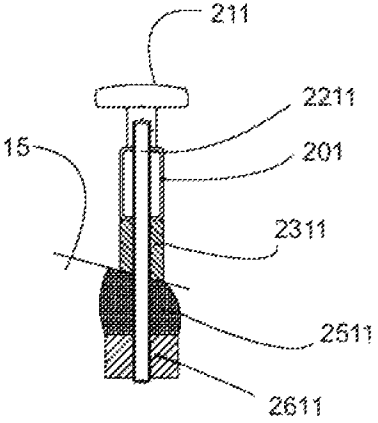
FIG. 4 shows the enlarged particular of an embodiment of one of the locking means for locking the equipment to the hull of the boat.

Finally, FIG. 4 shows the particular relating to the locking means 211 of the frame 1 with respect to the pit 15 for housing the centerboard. The locking means comprise the knob 211 acting on the threaded rod 2211 crossing the bow side 201 of the frame 1, whose rotation tightens the block 2511 of the elastically deformable material between the lower portion of the frame 2311 and the countering means 2611.

The operation and assembling of the equipment according to the present invention will become clearer hereunder. The structure of the frame 1, which can be made of box-shaped elements, preferably, but not necessarily stainless steel, allows the extreme simplicity of the structure and ensures its overall lightness. The locking by means of the respective means 331, 341, 211 and 221 ensures the stability of the equipment and its complete reliability. With the positioning of the seat 121, movable along the guides 111 inside the structure of the frame 1 thanks to the trolley 131 and rollers 141, it is possible to substantially replicate the rowing conditions of a rowing rig provided however with a hull adapted for coastal use and strongly much more stable than the currently used boats.

The different alternatives shown with respect to the positioning of the supporting members of the rowlocks allow to select the right balance between the extremely little dimensions, such as in the embodiment of FIG. 2, and the solution that privileges the stability of the coupling between the equipment and hull, as is clear in the embodiment of FIG. 3.

In terms of the locking of the frame 1 of the structure to the hull, it was highlighted, with the embodiment shown in FIG. 4, how the position of the frame with respect to the pit 15 of the movable centerboard can be efficiently exploited, by using the control of the expansion of the block of elastically yielding material 2511 by rotating the knob 211.

As is clear in particular in FIG. 2, a helm 13, comprising a blade swinging around a vertical axis and a bar for driving said blade, is combined with the hull, said bar being combined with control members delimiting the steering angle and/or regulating the rigidity of the helm and which are sent back inside the cockpit in a position accessible by the user.

As shown, said members are made up of two control lines 113 fixed at the end of the bar, which control lines branch off in directions opposite from the end thereof and are sent back, at the respective side of the hull, by return members 213 towards the cockpit, a removable locking member, such as for example a stopper 313 or the like, being provided at each side of the cockpit, preferably of each angle zone, and within which the end length 413 of each line is engaged.

By hauling or easing the two lines, it is possible to regulate the swinging freedom of the blade of the helm 13 by a steering angle selected by the user. This can be reduced until reaching a locking position of the helm in a predetermined angular position with respect to the longitudinal axis of the hull.

All the locking means are anyhow reversible and, as mentioned in the introduction, the further advantage of the equipment according to the present invention consists in providing the means for the use of the same hull for two different sports practices, with low costs and with a respective simplicity of assembling.

The invention claimed is:

1. Equipment for conversion of a sailboat hull, provided with a substantially rectangular cockpit, into a rowing boat, said equipment comprising:

- a frame, substantially rectangular, shaped to be arranged with two major sides at two major sides of the cockpit, said frame being provided with a removable locking system of said frame at the sailboat hull;
- two cantilever members, jutting out beyond sides of said hull and connected to said frame at one end and being provided with rowlocks on another end;
- a seat slidable along at least one couple of guides parallel to the major sides of said frame; and
- a footrest, configured to be oriented and to be fixed to said frame in an adjustable way on a side of the frame facing a stern of said hull.

2. Equipment according to claim 1, wherein each cantilever member comprises a couple of arms fixed at one end to the frame, spaced from each other and coupled with each other at an opposite end, the opposite end providing support to one of the rowlocks.

3. Equipment according to claim 1, wherein a cavity is provided inside the cockpit of the hull for housing a movable centerboard, further comprising locking means to lock said frame to said hull which comprise an expansion pivot configured to cooperate with the cavity of the movable centerboard.

4. Equipment according to claim 1, wherein said sailboat hull is a hull of Laser class.

5. Equipment according to claim 1, wherein said sailboat hull is a hull of Sunfish class.

6. Equipment for conversion of a sailboat hull, provided with a substantially rectangular cockpit, into a rowing boat, said equipment comprising a frame, substantially rectangular, shaped to be arranged with two major sides at two major sides of the cockpit, said frame being provided with a removable locking system of said frame at the sailboat hull;

two cantilever members, jutting out beyond sides of said hull and connected to said frame at one end and being provided with rowlocks on another end;

a seat slidable along at least one couple of guides parallel to the major sides of said frame; and a helm combined with the hull and comprising a blade swinging around a vertical axis and a bar for driving said blade, said bar being combined with control members delimiting a steering angle and/or regulating a rigidity of the helm and which are sent back inside the cockpit in a position accessible by a user.

7. Equipment according to claim 6, wherein said control members comprise two control lines fixed at an end of the bar, said control lines branching off in opposite directions from an end thereof and being sent back, at a respective broadside of the hull, by return members towards the cockpit, a removable locking member being provided at each side of the cockpit, and an end length of each line being engaged within the removable locking member.

8. Equipment for conversion of a sailboat hull, provided with a substantially rectangular cockpit, into a rowing boat, said equipment comprising:

a frame, substantially rectangular, shaped to be arranged with two major sides at two major sides of the cockpit, said frame being provided with a removable locking system of said frame at the sailboat hull;

two cantilever members, jutting out beyond sides of said hull and connected to said frame at one end and being provided with rowlocks on another end; and a seat slidable along at least one couple of guides parallel to the major sides of said frame, wherein said two cantilever members comprise two suitably oriented arms, each fixed to a junction angle between a side of the frame facing a stern of the sailboat hull and each of the two major sides of the frame.

9. Equipment for conversion of a sailboat hull, provided with a substantially rectangular cockpit, into a rowing boat, said equipment comprising:

a frame, substantially rectangular, shaped to be arranged with two major sides at two major sides of the cockpit, said frame being provided with a removable locking system of said frame at the sailboat hull;

two cantilever members, jutting out beyond sides of said hull and connected to said frame at one end and being provided with rowlocks on another end; and a seat slidable along at least one couple of guides parallel to the major sides of said frame, wherein said cantilever members each comprise an arm jutting out cantileverly from said frame, connected to a further arm at a support of the rowlock, said further arm being coupled to an edge of a respective side of the hull.

10. Equipment according to claim 9, wherein said further arm coupled with the edge of the respective side is adjustable in length.

* * * * *